US006174120B1

(12) United States Patent
Kalisher

(10) Patent No.: US 6,174,120 B1
(45) Date of Patent: Jan. 16, 2001

(54) APPARATUS FOR AFFIXING BOOK PAGES TO A BOOK COVER AND PROCESS FOR MAKING SAME

(76) Inventor: Yaakov Kalisher, 4201 Airborn, Dallas, TX (US) 75248

( * ) Notice: Under 35 U.S.C. 154(b), the term of this patent shall be extended for 0 days.

(21) Appl. No.: 08/923,893

(22) Filed: Sep. 4, 1997

(51) Int. Cl.[7] ..... B42D 3/02

(52) U.S. Cl. ..... 412/1; 412/4; 412/5; 412/8; 412/19; 412/24; 412/36; 412/901; 281/21.1; 281/15.1; 281/36; 281/37; 281/18; 281/19.1; 281/17

(58) Field of Search ..... 412/1, 4, 5, 8, 412/19, 24, 36, 901; 281/21.1, 15.1, 36, 37, 18, 19.1, 17

(56) References Cited

U.S. PATENT DOCUMENTS 3,825,963 * 7/1974 Abildgaard et al. ..... 412/901

* cited by examiner

*Primary Examiner*—Willmon Fridie, Jr.
*Assistant Examiner*—Mark T. Henderson

(57) ABSTRACT

An apparatus and method for affixing book pages to a book cover is disclosed having a sheet of paper with at least one waxy side and two stickers, each having a first side, the first side being sticky and removably affixed to the waxy side of the sheet of paper. In the preferred embodiment, the two stickers are separated by a distance to accommodate the thickness of pages of a book. The apparatus also has a means for easy removal of the stickers from said sheet and is preferably done by having the sheet of paper extending beyond each of the stickers to allow for easy separation of the stickers from the sheet of paper. The stickers may be attached to the book pages by a variety of means such as staples, channel binding, or otherwise. The method includes the steps of aligning one or more stickers removably attached to a sheet of paper with pages of a book, affixing the stickers to the book pages, removing at least part of the sheet of paper from the sticker, and attaching the sticker to an inside cover of a book. A preferred embodiment includes affixing the stickers to the book pages by stapling, U-shaped channel binding, or otherwise.

11 Claims, 2 Drawing Sheets

APPARATUS FOR AFFIXING BOOK PAGES TO A BOOK COVER AND PROCESS FOR MAKING SAME

BACKGROUND OF THE INVENTION

This invention relates generally to the field of book binding, and more particularly to an apparatus for affixing a cover to a book and process for making same.

There are many ways to bind book pages with hard or soft book cover cases together to form books, magazines, pamphlets and other types of printed material. One common method of binding is to use an adhesive to secure pages to a cover. A stack of book pages is covered on both its top and bottom side by separate cover pages or stickers, each of which has a protective covering coextensive with the stickers. Once these cover pages have been added to the top and bottom sides of the final stack of pages, the final stack, along with the cover pages, are stapled along one edge thereof. Each of the stickers is coated with an adhesive coating so that the cover pages may be secured or fastened to the insides of the empty book cover. When the book pages are ready to be secured to the book cover, the protective coverings are pealed back to expose the adhesive coating contained on the stickers. The final stack may be secured to the inside front and back book cover.

Employing the above method with the above devices, however, requires two separate and separated sticker sheets, frequently resulting in misalignment of the stickers with respect to the book pages and non-uniform results in affixing the book pages and cover. Further, the protective paper sheet is often difficult to separate from the stickers resulting in increased time and material waste in affixing the pages to the cover.

SUMMARY OF THE INVENTION

The primary advantage of the invention is to alleviate the need for two separated binding sheets or stickers in binding book pages to a book cover.

Another advantage of the invention is to alleviate the need for two separate binding sheets or stickers in binding book pages to a book cover.

Another advantage of the invention is to allow for easier alignment of binding pages with the book pages during the binding process.

A further advantage of the invention is to reduce the time spent in binding book pages to a book cover.

Yet another advantage of the invention is to allow easier separation between the paper backing sheet and the sticker during binding book pages to a book cover.

Still yet another advantage of the invention is to facilitate more uniform binding of book pages to a book cover.

Other advantages of the present invention will become apparent from the following descriptions, taken in connection with the accompanying drawings, wherein, by way of illustration and example, embodiments of the present invention are disclosed.

In accordance with a preferred embodiment of the invention, an apparatus for affixing book pages to a book cover comprises a sheet of paper having at least one waxy side, and two stickers, each having a first side, the first side being sticky and removably affixed to the waxy side of the sheet of paper, the two stickers being separated by a distance to accommodate pages of a book.

In accordance with another preferred embodiment of the invention, an apparatus for affixing book pages to a book cover comprises a sheet of paper having at least one waxy side, a sticker with a first side removably affixed to the waxy side of the sheet of paper, the sticker having a first section to attach book pages to the inside front cover of a book, the sticker having a second section to attach book pages to the inside book cover of a book, and the sticker having a third section between the first section and the second section to accommodate the thickness of book pages.

Also in accordance with the method of the present invention, a method for affixing book pages to a book cover comprises the steps of aligning one or more stickers removably attached to a sheet of paper with pages of a book, affixing the stickers to the book pages, removing at least part of the sheet of paper from the sticker, and attaching the sticker to an inside cover of a book.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

A detailed description of the preferred embodiments is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
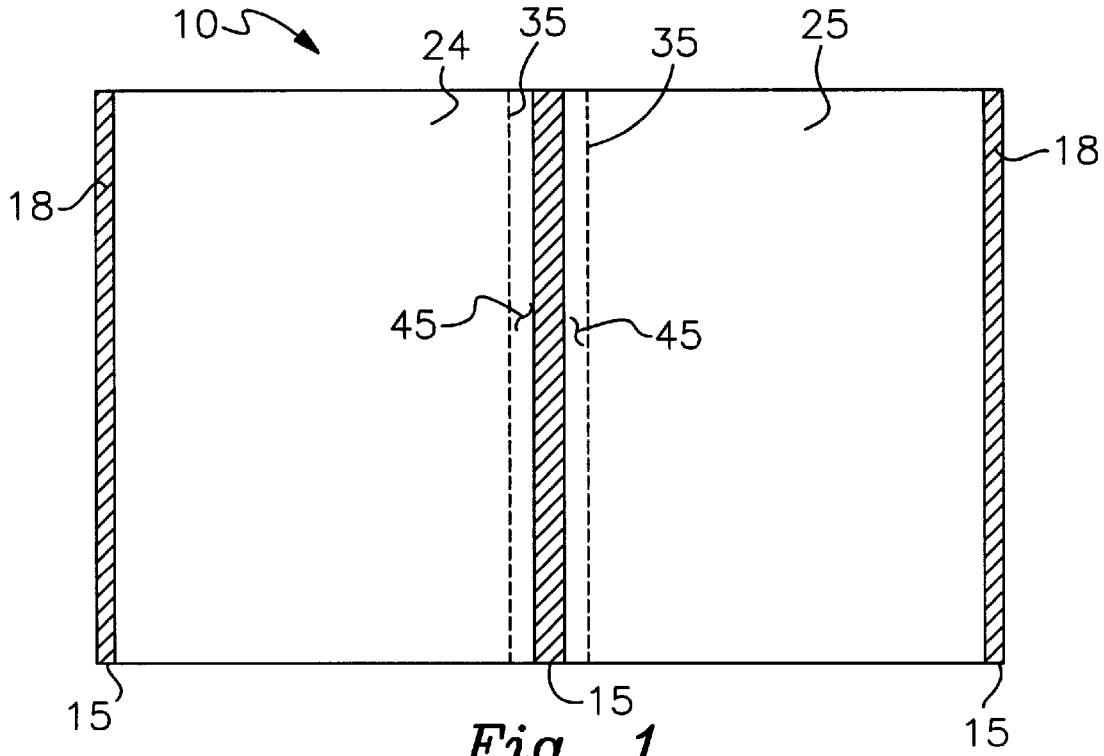
FIG. 1 is a plan view of the apparatus according to the present invention.

Turning first to FIG. 1 there is shown a plan view of an apparatus for affixing book pages to a book cover according to the present invention. The overall size of the apparatus 10 is approximately 8½ inches by 11 inches in the illustrated embodiment, though it will be appreciated that a variety of sizes may be employed without departing from the invention. In accordance with an important feature of the illustrated embodiment of the invention, a paper backing sheet 15 is shown. Removably affixed to the paper sheet 15 is shown two stickers 24 and 25. In order to be removably affixed to one another, the paper sheet 15 is waxy on one side while the mating side of stickers 24, 25 are sticky in a similar fashion to removable stickers of many sorts on the market and for sale in, for example, office supply stores. When removably affixed to the paper sheet 15, the exposed side of stickers 24, 25 may be of a variety of designs and constructions. For example, the exposed side of stickers 24, 25 may have a fanciful drawing or text thereupon. Alternately, the exposed side of stickers 24, 25 may also be sticky. In the event that the exposed side of stickers 24, 25 are sticky, a protective sheet (not shown), may cover the stickers. This protective sheet may also be of a waxy substance to facilitate removal and exposing the sticky side.

In accordance with another important feature of the present invention, there is show a means for easy removal of the paper sheet 15 from the stickers 24, 25. In the illustrated and preferred embodiment, to aid in easy removal, paper sheet 15 overhangs stickers 24, 25 by approximately 1/16 of an inch. Overhang portion 18 is shown in FIG. 1. it will be appreciated that the removal of paper sheet 15 from stickers 24, 25 may be by a variety of ways, including differing constructions of the over-hang portion, having a non-sticky portion to the sticky side of stickers 24, 25, a tab on a corner, a folded back portion to grab for removal, frictionally separating by rubbing the two between each other, etc. In addition, the means to allow easy removal of paper sheet 15 from stickers 24, 25 may be in a variety of locations, depending upon the particular application of the apparatus 10. For example, the removal mechanism may be located at the far corners of the stickers 24, 25, the near corners, the near sides, the far sides, etc., so long as to accommodate easy removal of paper sheet 15 in operation.

In accordance with another feature of the illustrated embodiment of the present invention, the stickers 24, 25 in FIG. 1 as depicted are separated by a space 27 designed to accommodate the thickness of the book pages stacked together. As will be apparent to those of skill in the art, depending upon the desired circumstances of operation, space 27 may be of a variety of dimensions. For the illustrated embodiment, the space 27 is designed as approximately 1/8 inch.

Another feature of the invention is illustrated in FIG. 1 and to limit unwanted tearing of book pages from the stickers 24, 25. This feature is shown at perforations 35. Perforations 35 are of the paper sheet 15 and are offset from the inner edges of stickers 24, 25 by, in the illustrated form, approximately 5/16 inches, but may be varied depending upon the intended circumstances, to create a binding area 45. In operation which is explained in detail below, binding area 45 is the area where the stickers 24, 25 are affixed to the book pages (not shown), later intended to be bound in a book cover (not shown). In operation, when the paper sheet 15 is removed from stickers 24, 25, the removal operation may place strain on the means affixing the book pages to the stickers 24, 25. For example, if staples or U-shaped channel binding were used to affix the stickers 24, 25 to book pages in binding area 45 and the paper sheet 15 were then removed in the binding operation, removing the paper sheet 15 may have an undesired impact on the staples or U-shaped channel. Accordingly there is employed a break away mechanism illustrated by perforations 35 in paper sheet 15 so that the means used to bind the book pages to the stickers 24, 25 in the binding area 45 may be left largely unaffected. Perforations 35 in paper sheet 15 create a section of paper 15 connecting the two stickers 24, 25 together. It will be appreciated that for particular applications perforations 35 may not be employed at all, or a different means may be used to accomplish the same result.

Figure 2:
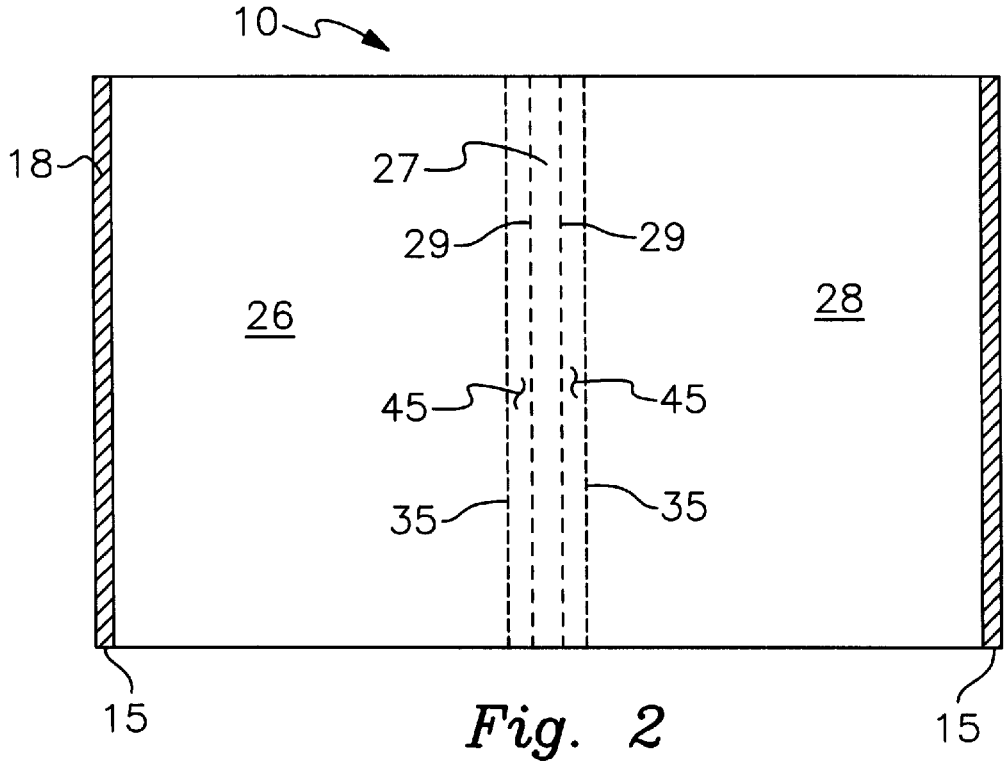
FIG. 2 is a plan view of the apparatus according to an alternate embodiment of the present invention.

Turning now to FIG. 2, there is shown an alternate embodiment of the invention where like structural features are shown with same numerical reference. Accordingly, paper sheet 15 is illustrated and is of similar construction to paper sheet 15 illustrated and described above with reference to FIG. 1. Further, paper sheet 15 is constructed with a mechanism for easy removal of the paper sheet 15 from the sticker. In the alternate embodiment as shown in FIG. 2, there is constructed a single sticker 37 (show as 26, 27, and 28, combined), with three sections. A first section 26 is shown having similar purpose to sticker 24 described in FIG. 1, above. Second section 28 is shown having similar purpose to sticker 25 described in FIG. 1, above. In addition, there is shown a third section 27 connecting the first section 26 to the second section 28 and perforated at perforations 29 to allow removal of the third section 27 in operation, if desired. It will be appreciated by those of skill in the art that removal of third section 27 is not desirable in every circumstance. Further, the width of the third section 27 may vary, depending upon the circumstances of intended use in a similar fashion to the variability of space 27 illustrated in FIG. 1, above to accommodate the thickness of a stack of book pages. In operation, it is contemplated that the sticky side of the first section 26 will be used to affix the stack of book pages to the inside front cover of the book cover, while the sticky side of the second section 28 will be used to affix the stack of book pages to the inside back cover of a book cover.

As described in connection with FIG. 1, above, the side of sticker 23, 34 and 25 of FIG. 2 not removably affixed to paper sheet 15 may be of a variety of designs and constructions, such as fanciful drawings, textual information, or sticky along with a corresponding protective paper sheet (not shown). Further, perforations 35 in paper sheet 15 are of similar construction and operation as perforations 35 in paper sheet 15 of FIG. 1, above. In addition and in a like manner, binding area 45 will not be re-described here, though is constructed and operates in a similar fashion to binding area 45 described in FIG. 1, above.

Figure 3:
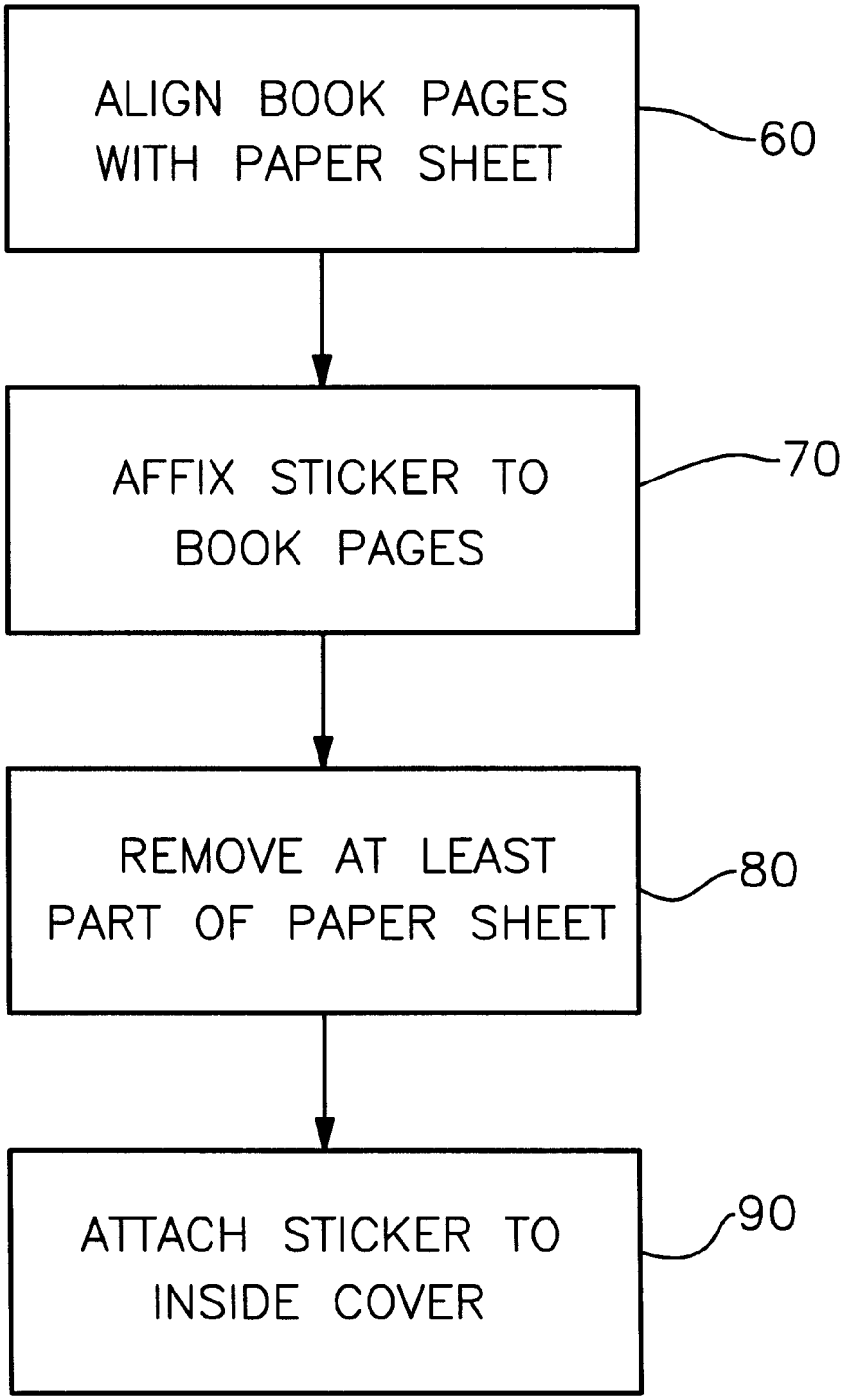
FIG. 3 is a flow chart of the operations that comprise the method according to the present invention.

Turning now to FIG. 3, there is shown a flow chart of the operation in accordance with the method of the present invention. As will be appreciated by those of ordinary skill in the art, in order to bind pages of a book to a book cover, a stack of book pages are to be aligned with the stickers, affixed to the stickers and the stickers are then to be affixed to the inside front and back covers of a book cover. In operation, either the apparatus of FIG. 1 , FIG. 2, or apparatus of similar construction may be employed. At step 60, the stack of book pages are aligned with the apparatus 10 so that the stickers may be easily aligned with the book pages. In order to facilitate easy alignment, the sticker(s) are attached to one another in the fashion described in accordance with FIG. 1, FIG. 2, or similarly.

Once the edges of the stack of book pages are aligned with apparatus 10 the sticker(s) are wrapped around the stack of book pages and affixed to the stack of book pages in an appropriate manner shown at step 70. For example this affixation may be made by staples, U-shaped channel binding, plastic binding, Velo® binding, spiral binding, or similar means. U-shaped channel binding is described in U.S. Pat. Nos. 4,986,713; 5,061,139; and 5,066,182.

In order to expose the sticky side of stickers 24, 25 (if the apparatus of FIG. 1 is employed), paper sheet 15 would then be at least partially removed from sticker 24, and the stack of book pages along with the sticker would be affixed to the inside cover of a book cover, see step 80. In order to affix the book pages to the inside back cover, the remainder of paper sheet 15 is removed, exposing the sticky side of sticker 25, for the example of the apparatus of FIG. 1. Thereafter, the stack of book pages along with the sticker 25 is affixed to the inside back cover of the book cover.

Those of ordinary skill in the art would appreciate that the use throughout this description of the inside front cover and the inside back cover may be interchanged. In addition, those of ordinary skill in the art would appreciate the use of the apparatus described in FIG. 2, or similar apparatus in the method described with regard to FIG. 3, above. Further the operation of the method in accordance with the present invention in connection with an apparatus of either FIG. 1, FIG. 2, or likewise having the second side of the sticker(s) also sticky with a protective paper sheet theron will be readily apparent to those of ordinary skill in the art as to when and how the paper sheet is removed during operation.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for affixing book pages to a book cover comprising:

a sheet of paper having at least one waxy side;

a sticker portion with a first side removably affixed to the waxy side of said sheet of paper;

said sticker portion having a first section to attach book pages to the inside front cover of a book;

said sticker portion having a second section to attach book pages to the inside back cover of a book; and said sticker portion having a third section between said first section and said second section to accommodate the thickness of book pages.

2. An apparatus as claimed in claim 1 further comprising means for easy removal of said sticker portion from said sheet.

3. An apparatus as claimed in claim 2 wherein said means for easy removal comprises extension of the sheet of paper beyond each of said stickers to allow for easy separation of the stickers from the sheet of paper.

4. An apparatus as claimed in claim 1 wherein the second side of said sticker portion is also sticky.

5. An apparatus as claimed in claim 1 wherein said sheet of paper further comprises a means to allow separation of said sheet into three sections including a section connecting one sticker to the other.

6. An apparatus as claimed in claim 5 wherein said means is by perforation.

7. An apparatus as claimed in claim 4 wherein said means is by scoring.

8. An apparatus as claimed in claim 1 further comprising a center section removably attached to both of said stickers.

9. A method for affixing book pages to a book cover comprising the steps of:

aligning one of or more stickers removably attached to a sheet of paper with pages of a book by wrapping the sheet of paper around the pages so that the one or more stickers are above a first page and below a last page;

afixing the one or more stikers to the book pages;

removing at least part of the sheet of paper from the sticker.

10. A method as claimed in claim 9 wherein affixing the stickers to the book pages is by stapling.

11. A method as claimed in claim 9 wherein affixing the stickers to the book pages is by binding such as channel binding.

* * * * *